United States Patent [19]

Olson

[11] Patent Number: 4,813,239

[45] Date of Patent: Mar. 21, 1989

[54] METHOD FOR DEFROSTING AND DEVICE FOR THE IMPLEMENTATION OF SAID METHOD

[76] Inventor: Hans E. E. Olson, Sigurdsgatan 28, S-214 65 Malmo, Sweden

[21] Appl. No.: 944,374

[22] Filed: Dec. 19, 1986

Related U.S. Application Data

[63] Continuation-in-part of Ser. No. 711,071, Mar. 12, 1985, abandoned.

[51] Int. Cl.[4] ..... F25D 21/06

[52] U.S. Cl. ..... 62/81; 62/278; 62/509; 62/510

[58] Field of Search ..... 62/278, 81, 510, 509, 62/196.4, 199, 200, 238.6, 277

[56] References Cited

U.S. PATENT DOCUMENTS

| | | | |
|---|---|---|---|
| 2,451,682 | 10/1948 | Lund | 62/278 X |
| 3,071,935 | 1/1963 | Kapeker | 62/278 X |
| 3,098,363 | 7/1963 | Shrader | 62/196.4 X |
| 3,301,002 | 1/1967 | McGrath | 62/238.6 X |
| 3,580,006 | 5/1971 | Quick | 62/278 X |
| 3,581,519 | 6/1971 | Garrett, Jr. | 62/510 X |
| 3,788,093 | 1/1974 | Lauterbach | 62/278 X |
| 4,389,851 | 6/1983 | Chrostowski et al. | 62/278 X |
| 4,437,317 | 3/1984 | Ibrahim | 62/278 X |
| 4,554,795 | 11/1985 | Ibrahim | 62/510 X |

*Primary Examiner*—Harry B. Tanner

*Attorney, Agent, or Firm*—Tarolli, Sundheim & Covell

[57] ABSTRACT

A refrigeration system comprises a plurality of evaporators and a plurality of conduits for feeding cooling-medium vapor evaporated in the evaporators to a plurality of compressors having a common outlet header for compression therein. Conduits extends between the common outlet header of the compressors and the inlets of the evaporators to feed the heated cooling-medium vapor produced by the compressors to one, several or all of the evaporators for defrosting the same.

6 Claims, 5 Drawing Sheets

METHOD FOR DEFROSTING AND DEVICE FOR THE IMPLEMENTATION OF SAID METHOD

This application is a continuation-in-part of U.S. patent application Ser. No. 711,071, filed Mar. 12, 1985 abandoned.

BACKGROUND OF THE INVENTION

The present invention relates to a method for defrosting one or more evaporators in a cooling system and/or one or more evaporators in a freezing system, whereby cooling-medium liquid is fed to the evaporators of said cooling and freezing systems, respectively, via an inlet conduit and evaporated in respective evaporator to cooling-medium vapor, which through an outlet conduit is fed to one or more compressors in the cooling and freezing systems, respectively, for compression to heated cooling-medium vapor, which from the compressor or compressors of the cooling system is fed to the evaporator or evaporators of the freezing system for defrosting thereof and from the compressor or compressors of the freezing system to the evaporator or evaporators of the cooling system for defrosting thereof. The invention also relates to a device for the implementation of this method.

Electric defrosting methods are normally used for defrosting evaporators. These methods, however, do not permit any quick-defrosting with a reasonable power consumption. Instead, there is a risk that the defrosting time becomes so long, that the products in the cooling and/or freezing plant reach injurious temperatures during the defrosting procedures.

SUMMARY OF THE INVENTION

The object of the present invention is to substantially improve the defrosting capacity at a reduced energy consumption and thereby reduce the defrosting time of the plant. This is arrived at according to the invention by feeding the heated cooling-medium vapor from the compressor or compressors of the freezing system to inlets of the evaporators of the cooling system and from the compressor or compressors of the cooling system to inlets of evaporators of the freezing systems. The object of the invention is also to provide a sample device for the implementation of this method. Such a device has according to the invention, a plurality of conduit means extending between common outlet means of the compressors and respective inlets of the evaporators.

By means of the method according to the invention, the thermal capacity of one or more evaporators may be used for quick-defrosting of one or more other evaporators. Hereby, the defrosting times may be reduced by half compared with the time of conventional defrosting methods.

With the device according to the invention, the present method may be carried out by simple means and furthermore, some previously necessary double arrangements may be reduced to only one arrangement which is common to several systems.

BRIEF DESCRIPTION OF THE DRAWINGS

The invention will be further described below with reference to the accompanying drawings, in which.

DESCRIPTION OF THE PREFERRED EMBODIMENTS

Figure 1:
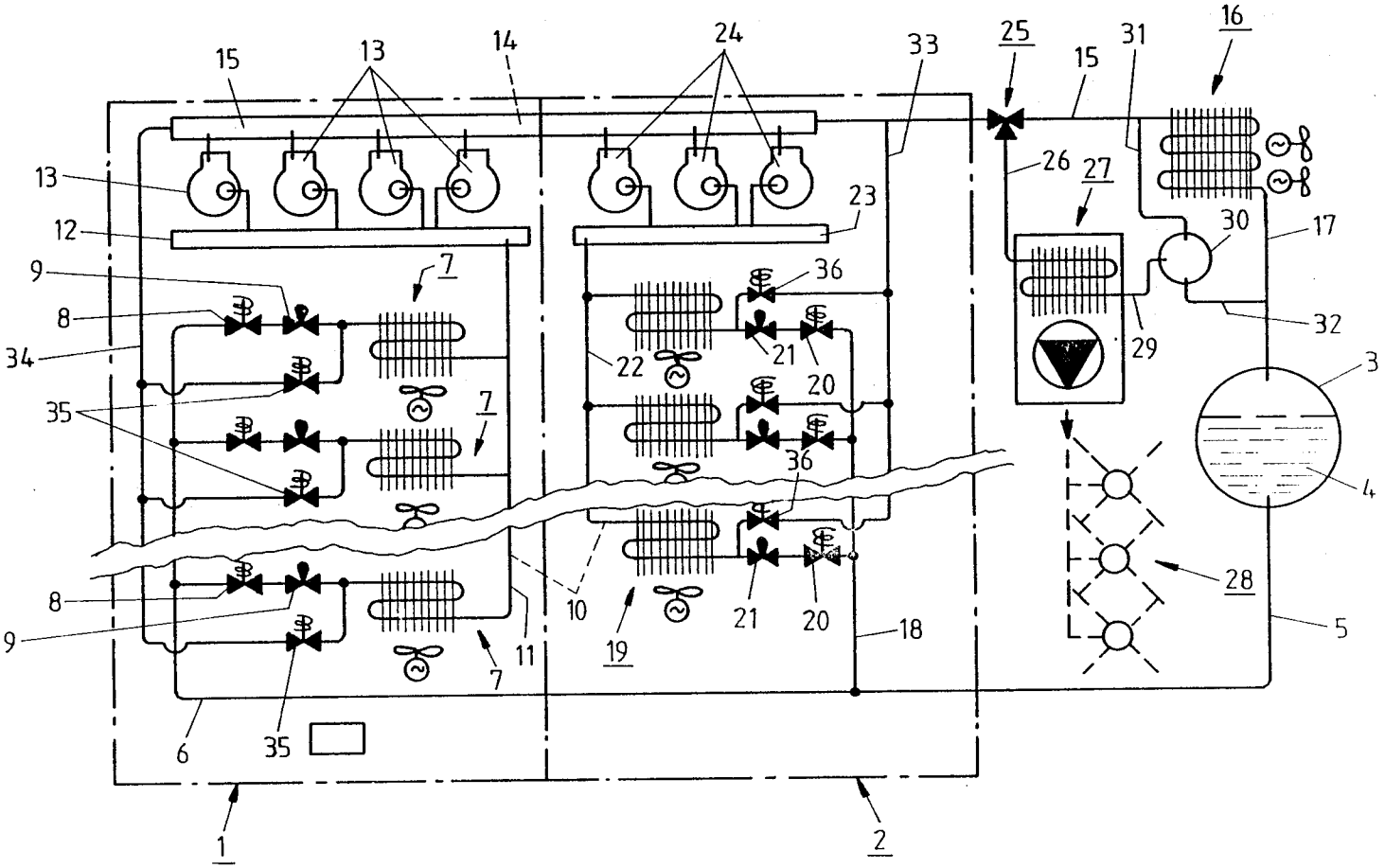
FIG. 1 schematically illustrates a cooling and freezing plant with a device according to the invention.

The cooling and freezing plant of FIG. 1 is intended for keeping products in a cooled and frozen condition and includes a cooling system 1 and a freezing system 2 therefor. The cooling and freezing plant has a container 3 for cooling-medium liquid 4 which is common to the cooling system 1 and the freezing system 2, said liquid being brought to said systems through a conduit 5. From the conduit 5, cooling-medium liquid is fed to the cooling system 1 via a conduit branch 6 and transferred to a number (e.g., five) of evaporators 7 in the cooling system 1. In the conduits 6 for feeding cooling-medium liquid 4 to each evaporator 7 there is provided a magnetic valve 8 and an expansive valve 9. The magnetic valve 8 is provided to, by blocking the conduit 6, prevent injection of cooling-medium liquid into each evaporator 7 during defrosting or prevent delivery of cooling-medium liquid to each evaporator 7 when the desired temperature has been reached in the space to be cooled. The expansion valve 9 is provided for injecting the cooling-medium liquid into each evaporator 7. By evaporation of the cooling-medium liquid 4 in the evaporators 7, neat is extracted from the environment. During this heat extraction cooling-medium vapor 10 is produced in the evaporators 7, and this vapor is via the outlets of the evaporators fed to a conduit 11 and through this conduit to a distribution conduit 12. Four compressors 13 are connected to the distribution conduit 12 and designed to transform the cooling-medium vapor 10 to heated gas 14 by compression. The heated gas 14 is fed through the outlets of the compressors 13 to a connecting conduit 15 common to the cooling and freezing systems and transferring the heated gas to a condenser device 16, which is also common to the cooling and freezing systems. In this condenser 16, the heated gas 14 is condensed, and the cooling-medium liquid thereby obtained is fed from the outlet of the condenser 16 through a conduit 17 to the container 3, whereby the circle is closed.

Cooling-medium liquid 4 is also fed from the container 3 through the conduit 5 and a conduit branch 18 to evaporators 19 (e.g., five) in the freezing system 2. The inlet to each evaporator 19 has a magnetic valve 20 and an expansion valve 21 and in each evaporator the cooling-medium liquid is evaporated during extraction of heat from the environment. The magnetic valve 20, by blocking the conduit 18, prevents injection of cooling-medium liquid into each evaporator 19 during defrosting or prevents delivery of cooling-medium liquid to each evaporator when the desired temperature is obtained in the space to be cooled. The expansion valve 21 is provided for injecting the cooling-medium liquid into each evaporator 19. If only one conduit **18*a* is leading from each expansion valve 21 to the coils 19*a* of each evaporator, each conduit branch 33 may be connected to said conduit 18*a* as is shown in the drawings. By the evaporation, cooling-medium vapor 10 is produced also here and said vapor is fed through a conduit 22 to a distribution conduit 23. Three compressors 24** are connected to the distribution conduit 23 and designed to, by compression, transform the vapor to heated gas 14, which is fed to the common connecting conduit 15 via the outlets of the compressors. Through this common conduit 15, the heated gas from the freezing system is thus also fed to the common condenser 16.

In order to recover heat from the condenser 16, the common connecting conduit 15 is provided with a valve 25 for deflecting the heated gas 1 through a conduit 26 to a recovery condenser 27. This condenser 27 emits heat which may be used for heating premises through air-feed units 28 or for heating water or another medium. The outlet of the condenser 27 is through a conduit 29 connected to a separating container 30 for separating gas from liquid if the condenser 27 delivers a mixture of ga and liquid. The separated gas is via a conduit 31 returned to the common connecting conduit 15 for condensation in the condenser 16, while the liquid is by-passed the condenser 16 via a conduit 32 and fed to the conduit 17 between the outlet of the condenser 16 and the container 3.

Figure 2:
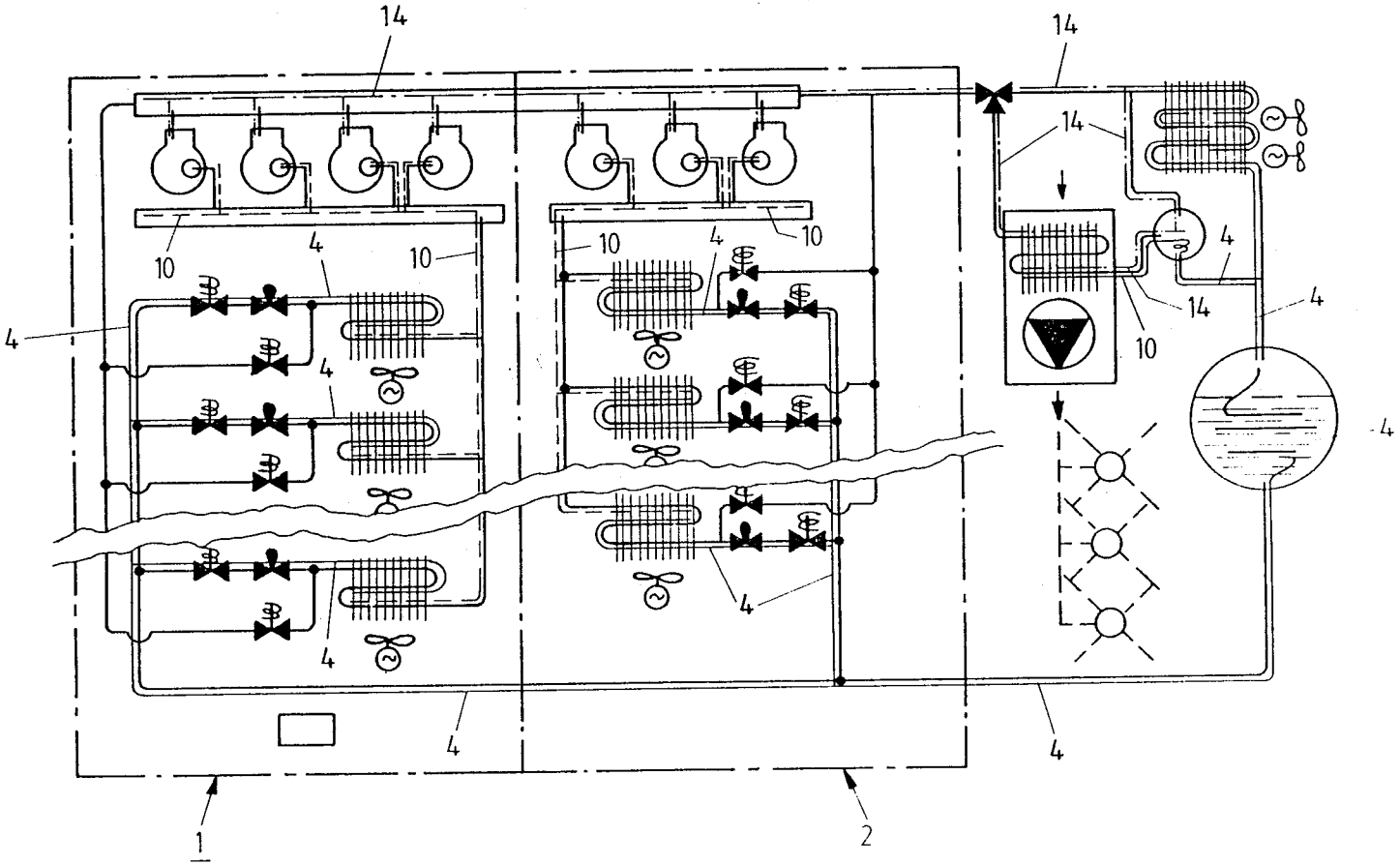
FIG. 2 illustrates the same plant during normal operation.

In FIG. 2, the plant is shown during normal operation, whereby the cooling medium liquid 4 is shown with solid lines along its respective conduits, the cooling-medium vapor 10 is shown with broken lines along its respective lines and finally, the heated gas 14 is shown with dotted and dashed lines along its respective conduits. Cooling medium liquid 4 is fed from the container 3 through the conduits 5 and 6 to the cooling system evaporators 7, wherein the liquid is evaporated during extraction of heat from the environment. The cooling-medium vapor thus produced, is fed through the conduit 11 to the distribution conduit 12 for uniform distribution of said vapor to the compressors 13. This uniform distribution is obtained while the distribution conduit 12 is designed such that the cooling-medium vapor 10 flows in said conduit 12 with a substantially reduced velocity, preferably below 2 m/s. The heated gas 14 generated by the compression of the cooling-medium vapor 10 in the compressors 13, is fed through the common connecting conduit 15 to the condenser 16, wherein, the gas is condensed and the cooling-medium liquid 4 thereby obtained is fed to the container 3.

In the freezing system 2, the same process occurs with the difference however, that the evaporation temperature in the evaporators of the freezing system is different.

The capacity of the recovery condenser 27 may be fully used irrespective of the number of compressors loading said condenser and will still permit a low condensing temperature (of e.g., +30° C.). If, e.g., one of the compressors is in operation, the capacity of the recovery condenser 27 will be sufficiently large to permit full condensation at, e.g., +30° C. In this case, the discharge of the recovery condenser 27 merely contains cooling-medium liquid 4 which is fed through the conduit 29 to the separating container 30. Since a float valve in the separating container 30 opens, said liquid may flow through the conduit 32 to the conduit 17 and return to the container 3 therethrough. If, e.g., all seven compressors load the recovery condenser 27, full condensation is not obtained therein and a portion of the cooling-medium vapor will flow out of the condenser 27 through the conduit 29 along with the liquid. The vapor and liquid will be separated in the separating container 30 as previously described. By means of this device the condensing temperature in the recovery condenser 27 will always be low irrespective of the number of compressors in operation.

Figure 3:
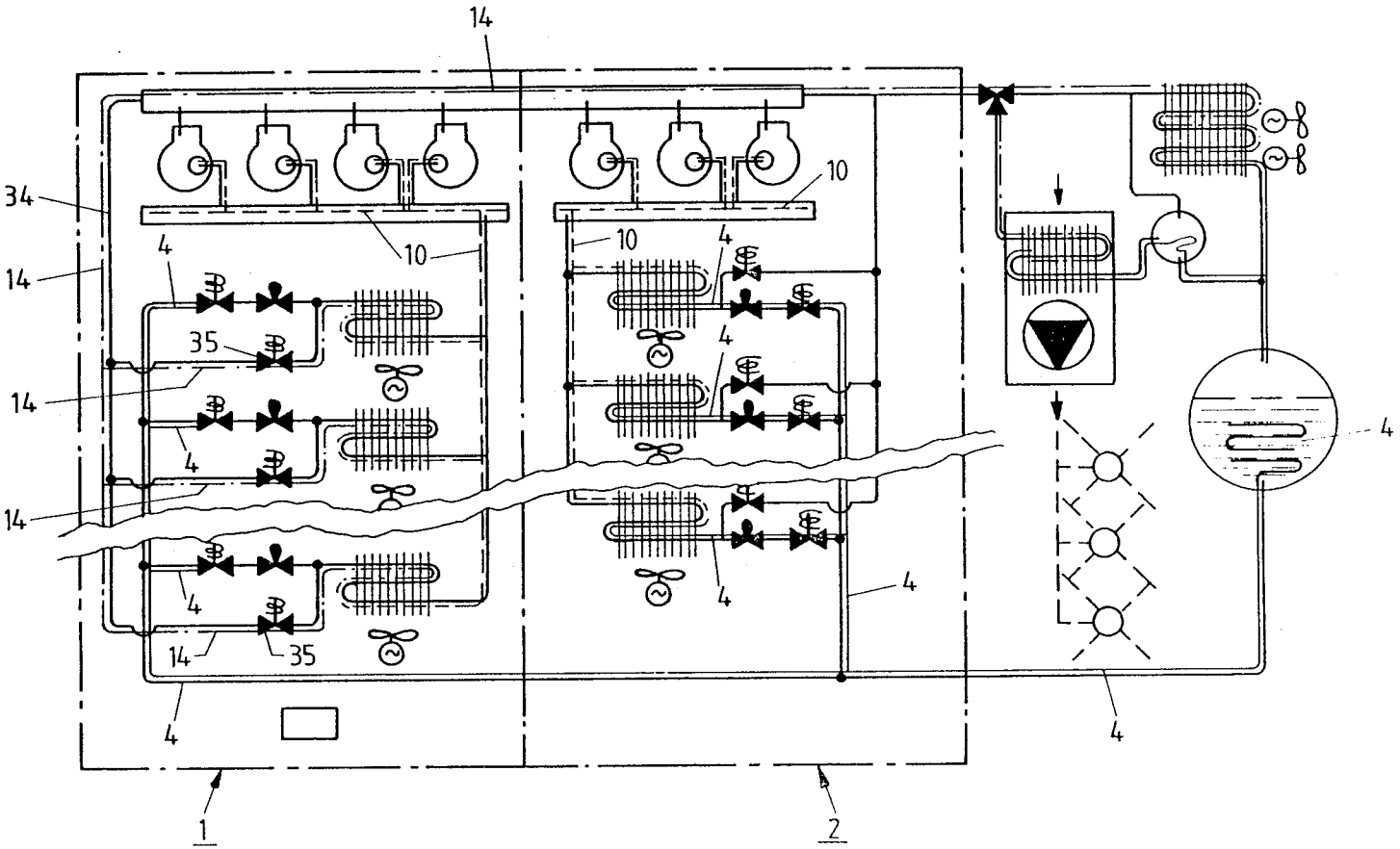
FIG. 3 illustrates the plant during defrosting of the cooling system.

For defrosting one or several of the evaporator 7 of the cooling system 1, the operation of the freezing system 2 is continued as normal operation and the magnetic valve 8 in the conduit 6 is closed such that no cooling-medium liquid 4 is fed to a respective evaporator 7. Instead, a magnetic valve 35 (see FIG. 3) in a conduit branch 34 leading from the connecting conduit 15 to the the respective evaporator 7 opens. If only one conduit **6*a* is leading from each expansion valve 9 to the coils 7*a* of each evaporator 7, each conduit branch 34 may be connected to said conduit 6*a* as is shown in the drawings. Through said conduit branch 34, the heated gas 14 from the compressors 24 in the freezing system 2 is fed to the respective evaporator 7, which means that the heated gas from the freezing system is used for defrosting the respective evaporator 7 in the cooling system 1**.

Figure 4:
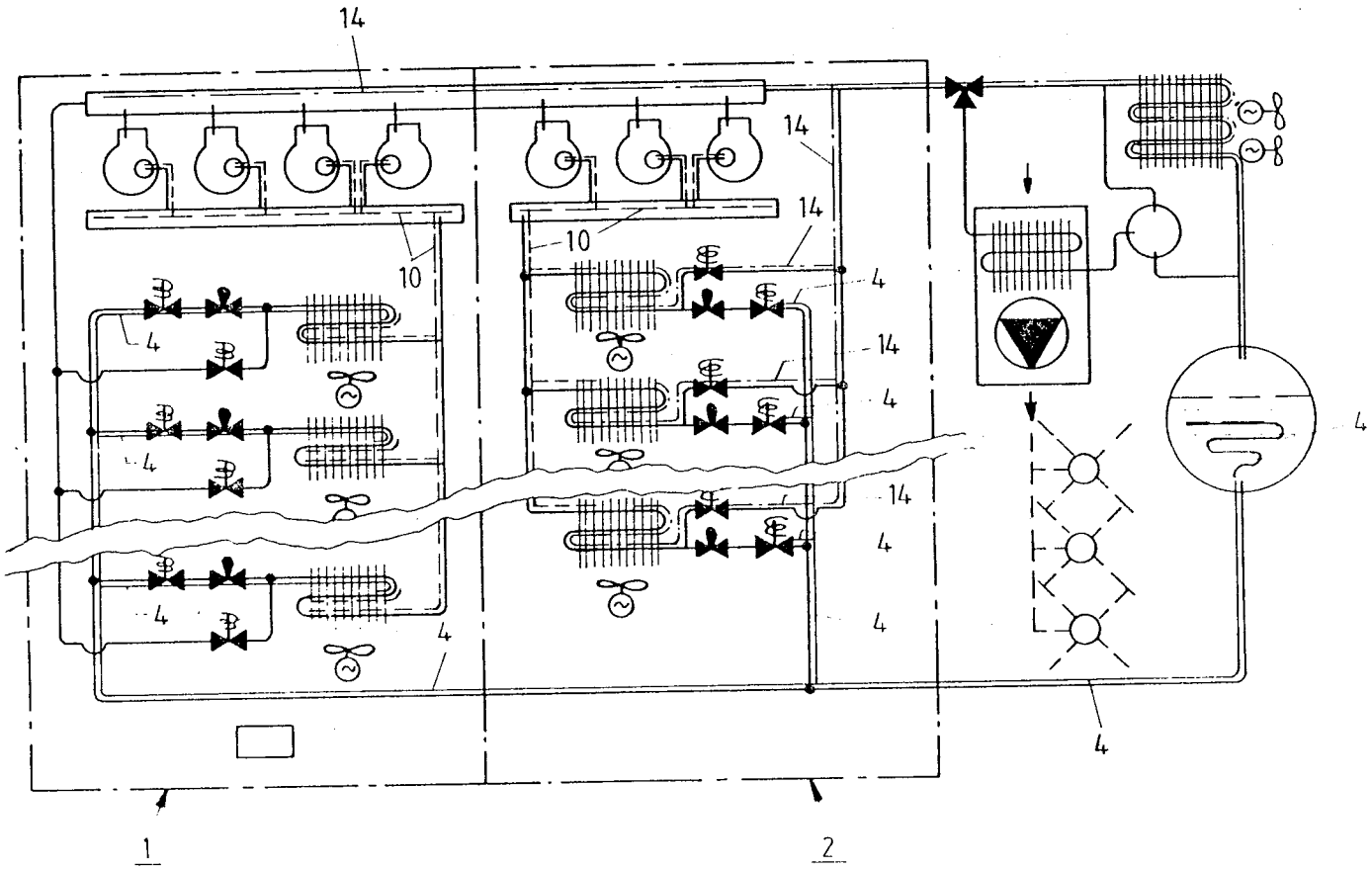
FIG. 4 illustrates the planar during defrosting of the freezing system.

For defrosting one or several of the evaporators 19 of the freezing system 2, the operation of the cooling system 1 is continued as normal operation and the magnetic valve 20 in the conduit 18 is closed such that no cooling-medium liquid 4 is fed to a respective evaporator 19. Instead, a magnetic valve 36 (see FIG. 4) in the conduit branch 33 opens, said branch leding from the connecting conduit 15 to the respective evaporator 19. Through said conduit branch 33, the heated gas 14 from the compressors 13 in the cooling system 1 is fed to the respective evaporator 19, which means that the heated gas from the cooling system is used for defrosting the respective evaporator 19 in the freezing system 2.

When defrosting the evaporators 7 and 19 the temperature of the heated gas decreases, but this temperature decrease is preferably limited such that no total condensation occurs. Instead, a saturated cooling-medium vapor 10 is obtained, which is transformed to heated gas 14 in each compressor and brought back to the evaporators to promote the continued defrosting.

The defrosting process described above means that the heat capacity of the cooling system 1 is utilized to quickly defrost the evaporators of the freezing system 2 and that the heat capacity of the freezing system 2 is used to quickly defrost the evaporators of the cooling system 1. The defrosting effect of the plant is thus so large that any required defrosting is obtained in four to ten minutes, which is only half the time required for conventional electric defrosting.

The present defrosting method is obtained in a simple manner by connecting extra conduits 33 and 34 with associated magnetic valves 35 and 36. Furthermore, the defrosting device illustrated in the drawings needs only one condenser for condensing warm gas from both systems and needs only one container for cooling-medium liquid for both systems.

The method described above and the plant illustrated in the drawings permit defrosting of one or more of the evaporators in the cooling system 1 by means of the heated gas produced in one or more of the other evaporators in the cooling system.

If, i.e., the upper evaporator 7 in the cooling system 1 shall be defrosted, its magnetic valve 8 is closed such that the flow of cooling-medium liquid thereto is interrupted. Instead, its magnetic valve 35 is opened so that heated gas 14, produced by compression of cooling-medium vapor 10 from the other evaporators 7, may flow into the evaporator in question via the connecting conduit 15 and the extra conduit 34.

If instead, the upper evaporator 19 in the freezing system 2 shall be defrosted, its magnetic valve 20 is closed such that the flow of cooling-medium liquid thereto is cut off. Instead, its magnetic valve 36 is opened so that heated gas 14, produced by compression of cooling-medium vapor 10 from the other evaporators 19, may flow into the evaporator in question via the connecting conduit 15 and the extra conduit 33.

Figure 5:
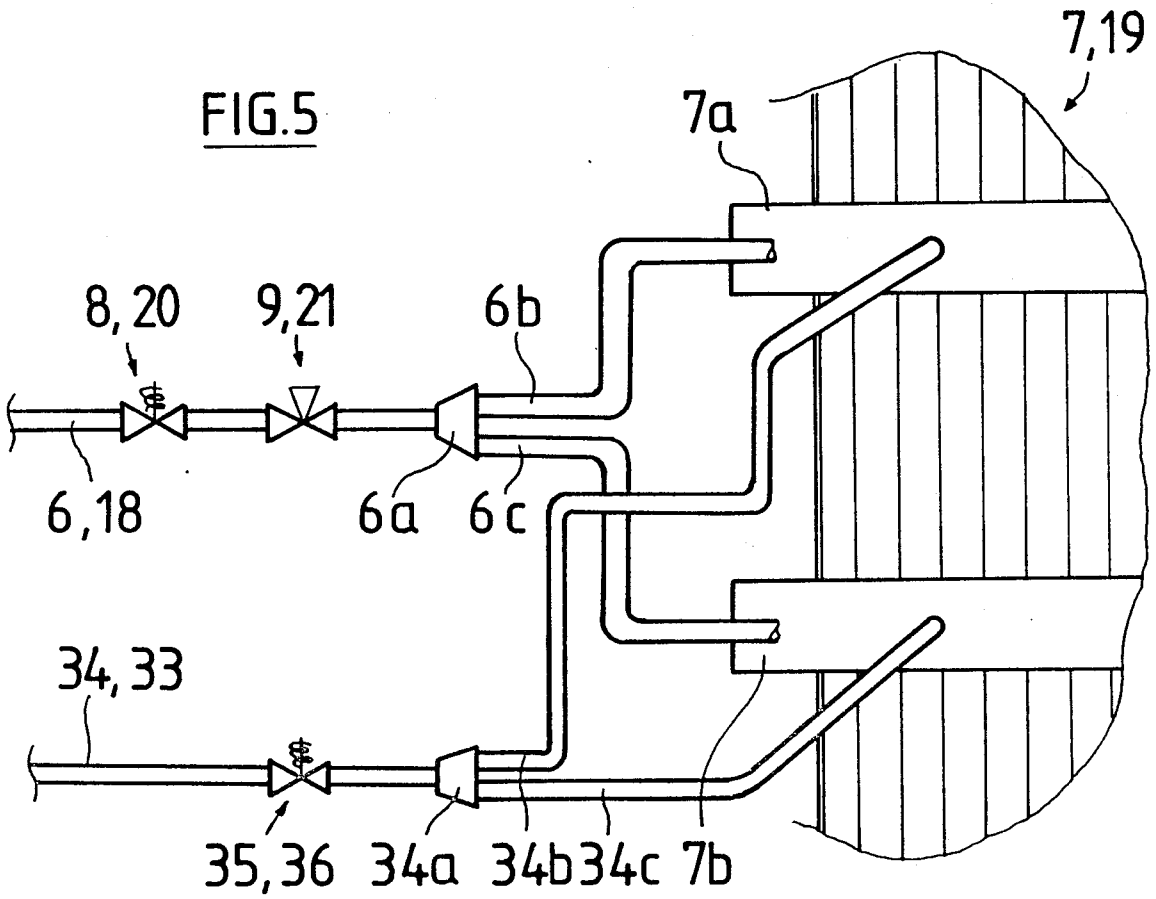
FIG. 5 illustrates a fragmentary view of another embodiment of a cooling and freezing plant with a device according to the present invention.

FIG. 5 discloses another embodiment of the subject invention in which the cooling-medium vapor 14 flowing from the respective compressor system 13 and 24, respectively, through the conduits 34 and 33, respectively is distributed in a distributor unit 34*a* to two or more conduit branches 34*b* and 34*c*, which are connected to two or more evaporator-pipe windings 7*a*, 7*b* in each evaporator 7 and 19, respectively. Branching the hot gas conduits 33, 34 into several conduits permits to substantially increase gas volume in each evaporator in a short period of time and obtain a very advantageous quick-defrosting effect. The number of evaporator-pipe windings 7*a*, 7*b* and associated conduit branches 34*b*, 34*c* may vary from two to a large number depending on the size of the respective evaporator, the construction thereof and the requirement for quick-defrosting.

Since each evaporator 7, 19 has two or more evaporator-pipe windings 7*a*, 7*b*, the inlet conduit 6 and 18, respectively, with the valves 8, 9 and 20, 21, respectively, branches off through a distributor unit 6*a* into two or more conduit branches 6*b*, 6*c*, which are connected to the respective evaporator-pipe windings 7*a*, 7*b* in the respective evaporator 7 and 19.

The method described above is applicable for defrosting combined cooling and freezing systems or for defrosting a separate cooling system 1 or a separate freezing system 2. At all times, it is possible to defrost one, more or all the evaporators.

The method and device described above may vary within the scope of the following claims. Thus, warm gas may be transferred between the systems in various ways for defrosting and the devices therefor may be of another type than illustrated. Each system may be constructed in other ways than shown; each system may, e.g., comprise one, two, three, four, five or more evaporators and one, two, three, four, or more compressors, depending on the desired cooling and freezing capacity respectively, of the plant. The method of condensing the warm gas from both systems in a condenser and the device therefor, may vary in function and construction, e.g., more than one condenser 16 may be used and the heat recovery system 26, 27, 28, 29, 30, 31 and 32 may be designed in another way or dispensed with if no heat recovery is desired.

I claim:

1. A method of defrosting evaporators in a refrigeration system, which system comprises a first plurality of evaporators operating at a first temperature level and a second plurality of evaporators operating at a second temperature level different from said first temperature level, and wherein at least one evaporator in at least one of said first and second pluralities of evaporators may be defrosted during operation of said refrigeration system, said method comprising the steps of:

feeding a cooling medium liquid to inlets of the evaporators in said first and second pluralities of evaporators and evaporating the cooling medium liquid therein;

feeding the cooling medium vapor from outlets of the evaporators in the first and second pluralities of evaporators to first and second pluralities of compressors, respectively, for compressing the cooling medium vapor therein whereby the cooling medium vapor is heated;

feeding the heated cooling medium vapor from said first and second pluralities of compressors to a common header;

feeding the heated cooling medium vapor from said common header to condensor means for condensing heated cooling medium vapor;

blocking flow of cooling medium liquid to the inlet of said one evaporator in said one of said first and second pluralities of evaporators; and continuously feeding the heated cooling medium vapor from said common header through conduit means extending between said common header and the inlet of said one evaporator to the inlet of said one evaporator independently of pressure in said condensor means until said one evaporator is completely defrosted.

2. Method as set forth in claim 1 including the step of transferring a portion of heated cooling-medium vapor to a heat recovery condenser for recovering heat from the heated cooling-medium vapor for using the heat for heating purposes and the step of feeding a mixture of the cooling-medium vapor and the cooling-medium liquid produced in the heat recovery condensor because of incomplete condensation of the heated cooling medium vapor to a separating container for separating the cooling-medium vapor from the cooling-medium liquid.

3. Method as set forth in claim 1 including the step of lowering the temperature of the heated cooling-medium vapor during defrosting to a level at which a saturated cooling-medium vapor is produced and feeding said saturated cooling-medium vapor back to said compressor means.

4. Method as set forth in claim 1 wherein said step of feeding cooling-medium vapor from said first and second pluralities of evaporators, respectively, to said first and second pluralities of compressors, respectively, includes the step of feeding the cooling-medium vapor from said first plurality of evaporators to a first distribution conduit common to all compressors in said first plurality of compressors and feeding the cooling-medium vapor from said second plurality of evaporators to a second distribution conduit common to all compressors in said second plurality of compressors, and the step of reducing the flow velocity of the cooling-medium vapor in said first and second distribution conduits to insure uniform distribution feeding of the cooling-medium vapor to said first and second pluralities of compressors, respectively.

5. A refrigeration system comprising:

a first plurality of evaporators operating at a first temperature level and a second plurality of evaporators operating at a second temperature level different from said first temperature level;

a plurality of first and second conduit means for feeding cooling medium liquid to the evaporators of said first and second pluralities of evaporators, respectively;

a plurality of first valve means located in the first conduit means for controlling flow of the cooling medium liquid to inlets of said first plurality of evaporators and a plurality of second valve means located in the second conduit means for controlling flow of the cooling medium liquid to inlets of said second plurality of evaporators, said first and second valve means having an open position in which the cooling medium liquid flows to respective inlets of said evaporators of said first and second pluralities of evaporators and a closed position in which flow of cooling medium liquid to respective inlets is blocked;

a first plurality of compressors in which the cooling medium vapor evaporated in said first plurality of evaporators is compressed and a second plurality of compressors in which the cooling medium vapor evaporated in said second plurality of evaporators is compressed;

a common header connected with outlets of compressors in said first and second pluralities of compressors;

first condensor means;

third conduit means for communicating the heated cooling medium vapor from said common header to inlets of all evaporators in said first plurality of evaporators, fourth conduit means for communicating the heated cooling medium vapor from said common header to inlets of all evaporators in said second plurality of evaporators, and fifth conduit means for communicating the heated cooling medium vapor from said common header to said first condensor means; and a plurality of third valve means located in said third conduit means for controlling flow of heated cooling medium vapor to inlets of said first plurality of evaporators when said first valve means is in its closed position, and a plurality of fourth valve means arranged located in said fourth conduit means for controlling flow of heated cooling medium vapor to inlets of said second plurality of evaporators when said second valve means is in its closed position.

6. A refrigeration system comprising:

a first plurality of evaporators operating at a first temperature level and a second plurality of evaporators operating at a second temperature level different from said first temperature level;

a plurality of first conduit means for feeding cooling medium liquid to the evaporators of said first plurality of evaporators and a plurality of second conduit means for feeding cooling medium liquid to the evaporators of said second plurality of evaporators;

a plurality of first valve means located in the first conduit means for controlling flow of the cooling medium liquid to inlets of evaporators of said first plurality of evaporators and a plurality of second valve means located in the second conduit means for controlling flow of the cooling medium liquid to inlets of evaporator of said second plurality of evaporators, said first and second valve means having an open position in which the cooling medium liquid flows to respective inlets of said evaporators of said first and second pluralities of evaporators and a closed position in which flow of cooling medium liquid to respective inlets is blocked;

a first plurality of compressors in which the cooling medium vapor evaporated in said first plurality of evaporators is compressed and a second plurality of compressors in which the cooling medium vapor evaporated in said second plurality of evaporators is compressed;

a common header connected with outlets of compressors in said first and second pluralities of compressors;

third conduit means for communicating the heated cooling medium vapor from said common header to inlets of all evaporators in said first plurality of evaporators, and fourth conduit means for communicating the heated cooling medium vapor from said common header to inlets of all evaporators in said second plurality of evaporators; and a plurality of third valve means located in said third conduit means for controlling flow of heated cooling medium vapor to inlets of evaporators of said first plurality of evaporators, and a plurality of fourth valve means located in said fourth conduit means for controlling flow of heated cooling medium vapor to inlets of evaporators of said second plurality of evaporators;

each of the evaporators of at least one of said first and second pluralities of evaporators comprising a plurality of evaporator-pipe windings, each conduit means of the respective one of said pluralities of first and second conduit means comprising a plurality of conduits corresponding in number to the number of said evaporator-pipe winding and extending between a respective one of said first and second valve means and a respective evaporator, for communicating cooling medium liquid separately to said evaporator-pipe windings, and each conduit means of the respective one of said pluralities of third and fourth conduit means comprising a plurality of conduits corresponding in number to the number of said evaporator-pipe windings and extending between a respective one of said third and fourth valve means and said evaporator-pipe winding for communicating heated cooling medium vapor separately to said evaporator-pipe windings of the respective evaporator.

* * * * *